US011987421B2

(12) United States Patent
Marghitoiu

(10) Patent No.: US 11,987,421 B2
(45) Date of Patent: May 21, 2024

(54) METHOD FOR EMPLOYING CONTAINERS WITH REMOVABLE SAMPLE COMPARTMENTS

(71) Applicant: Anatolia Liliana Marghitoiu, Simi Valley, CA (US)

(72) Inventor: Anatolia Liliana Marghitoiu, Simi Valley, CA (US)

( * ) Notice: Subject to any disclaimer, the term of this patent is extended or adjusted under 35 U.S.C. 154(b) by 549 days.

(21) Appl. No.: 16/925,237

(22) Filed: Jul. 9, 2020

(65) Prior Publication Data

US 2022/0009673 A1 Jan. 13, 2022

(51) Int. Cl.
*B65D 21/02* (2006.01)
*B65B 5/04* (2006.01)

(52) U.S. Cl.
CPC ..... *B65D 21/0228* (2013.01); *B65B 5/04* (2013.01); *B65D 21/0233* (2013.01); *B65B 2230/02* (2013.01); *B65D 2221/00* (2013.01)

(58) Field of Classification Search
CPC ..... B65D 2221/00; B65D 51/28; B65D 21/0228; B65D 21/0233; B65D 23/12; B65B 2220/16; B65B 2230/02; B65B 5/04
USPC ..... 53/473; 206/730–734, 216; 215/6, 227; 220/521
See application file for complete search history.

(56) References Cited

U.S. PATENT DOCUMENTS 3,367,484 A * 2/1968 Nelson ..... B65D 51/28 426/115
3,384,259 A 5/1968 Hoffstadt
3,511,022 A * 5/1970 Bowen ..... B65B 55/027 53/512
5,879,769 A * 3/1999 Greenland ..... A45D 40/0087 428/36.1
5,960,947 A * 10/1999 Dimelis ..... B65D 23/14 206/730
5,996,781 A * 12/1999 Glaser ..... A47G 19/2227 206/217
6,145,685 A * 11/2000 Dick ..... B65D 21/0228 220/23.91
6,461,043 B1 * 10/2002 Healy ..... B65D 33/2508 383/61.3
9,111,275 B2 * 8/2015 Miller ..... G06Q 20/28
10,173,802 B2 * 1/2019 Carpenter ..... B65D 25/08
(Continued)

*Primary Examiner* — Joshua G Kotis

(74) *Attorney, Agent, or Firm* — Michael L. Greenberg, Esq.; Greenberg & Lieberman, LLC

(57) ABSTRACT

The present invention is a method featuring containers for consumable products which have removable sample compartments to facilitate reuse, product returns post-trial, and product resale. The sample compartments are filled with the same product as the main compartment so that consumers may sample the product without damaging a tamper-proof seal on the main compartment. The used sample container may be refilled or replaced with a new sample container. Use of these containers may reduce waste by preserving the product in the main container in a sealed condition. Use of these containers may also minimize the return expense of products sold online by giving the consumer a chance to try the product and return the main container if they are unsatisfied, ultimately reducing the overall the cost per product and reducing the waste of both product and container or container materials.

16 Claims, 8 Drawing Sheets

(56) References Cited

U.S. PATENT DOCUMENTS

| | | | | |
|---|---|---|---|---|
| 2003/0009989 | A1* | 1/2003 | Knoerzer | B65B 9/2028 53/551 |
| 2006/0191932 | A1 | 8/2006 | Bocola | |
| 2006/0292270 | A1* | 12/2006 | Chitron | B65D 75/54 426/129 |
| 2007/0221602 | A1 | 9/2007 | Dib | |
| 2009/0107859 | A1* | 4/2009 | Cai | B65D 21/0237 206/217 |
| 2012/0043334 | A1* | 2/2012 | Nowzari | B65D 51/28 220/288 |
| 2012/0193316 | A1* | 8/2012 | Starks | B65D 81/3205 215/6 |
| 2014/0238949 | A1* | 8/2014 | Patel | B65D 81/3205 215/6 |
| 2018/0141712 | A1* | 5/2018 | Hendricks | B65D 21/083 |

* cited by examiner

METHOD FOR EMPLOYING CONTAINERS WITH REMOVABLE SAMPLE COMPARTMENTS

FIELD OF THE PRESENT INVENTION

The present invention relates to a method for employing containers for consumable products. More specifically, the present invention relates to a method for employing containers which have a main compartment and a removable sample compartment which can be filled with the same product so as to allow for sampling of the product without damaging a tamper-proof seal on the main compartment and compromising the product. The removable sample compartment can be refilled as applicable, and can also be used through refilling as a travel container.

BACKGROUND OF THE PRESENT INVENTION

Many types of consumable products are packaged in containers and sold to consumers. Often, the products undergo a long journey between packaging and eventual use by the consumer. In order to ensure preservation of quality, the containers are often sealed so as to prevent tampering with the product, and to provide an indication of potential tampering if the seal has been damaged or removed. Early seals were often formed using wax, however, more recently, plastics and other types of materials have been commonly used as seals.

While tamper-proof seals are helpful in protecting the product and promoting and ensuring consumer satisfaction and assurance of product quality, there are some associated problems. First, in order to test and/or try the product at all, the seal must be broken. Once the seal is broken, the value of the product may be greatly reduced or completely lost. Resale of "opened" goods or those with a broken seal is more difficult than resale of "unopened" goods as the buyer has less of a guarantee of product quality. In fact, for many types of products, the resale of opened goods is banned or impossible because of the possibility of adulteration or alteration of the products. Because of this, sellers often either refuse return of opened goods or are forced to discard the returned opened goods. Either option is costly to producers, results in major environmental waste, or both.

Dib (US 2007/0221602) shows a combination food and beverage bottle with removable base, but it does not really solve the above stated problem, nor does it have an associated process for doing so. Dib has a beverage in one compartment while a smaller, lower compartment contains food. Unlike the present invention, there is no method for providing the same substance in two compartments for a prioritized use of a smaller compartment first.

Hoffstadt (U.S. Pat. No. 3,384,259) shows a dual thermal carrier, but it does not provide a solution to the above stated problem either. Hoffstadt does not have a method for ensuring that the substance in the main compartment remains undisturbed while the same substance in the smaller compartment only is accessed.

Bocola (US 2006/0191932) shows a closure element for cosmetic product containers and the like, but again, there is no method provided for restoring a partially used product to its original state for resale.

Thus, there is still a need for a method to prevent resale of opened goods that is typically banned or impossible because of the possibility of adulteration or alteration of the products. And, there is still a need for a method to as a solution to sellers often either refusing return of opened goods or being forced to discard the returned opened goods.

SUMMARY OF THE PRESENT INVENTION

It is an objective of the present invention to provide a method which combined with suitable containers devices and systems—allows for sampling of a consumable product without breaking a main compartment seal and opening or altering the product. Embodiments of various containers are described and shown in the present disclosure, and the present invention employs such containers in a method that allows for distribution of a product while providing that the product can be resold upon return. Embodiments of the containers used in the present invention can be freely combined with each other if they are not mutually exclusive.

The present invention features containers which include a main compartment and one or more removably attached sample compartments to facilitate a method of trial sale/sampling of product as well as the integration of a travel compartment for ease of transport of the product by the end user (consumer). For example, the sample compartment may contain about 3 or more uses worth of the same product as the main compartment. The sample product may even be from the same production batch as the product in the main compartment so as to increase customer satisfaction by giving the consumer a chance to try the product with identical composition to the main compartment product, and to minimize production costs due to testing. The sample compartment may be affixed to the base of the main compartment, integrated within a double cap which fits over a main compartment opening, or inserted into a cavity in the bottom, side, or top or the main compartment.

The sample compartments may be added to a wide variety of containers without significant redesign or change in packaging appearance. For example, the majority of a product packaging could remain unchanged while only the cap is modified to include the sample compartment. Alternatively, the majority of a product packaging could remain unchanged while the base of the container is modified to allow for attachment of a sample compartment with the same or similar appearance as the original container's base. In some cases, the original container may be modified to add an external flange, hinge, indentation or other feature to allow for attachment of the sample container.

One of the unique and inventive technical features of the present invention is a removable sample product compartment which may be accessed and replaced without damaging a main compartment tamper-proof seal and compromising the actual product. Without wishing to limit the invention to any theory or mechanism, it is believed that the technical feature of the present invention advantageously provides for testing of the consumable product without breaking the tamper-proof seal thus maintaining product integrity while giving the consumer opportunity to try and evaluate the product, thus allowing the main product to be returned and resold. None of the presently known prior references or work has the unique inventive technical feature of the present invention. Furthermore, the prior references teach away from the present invention. For example, the industry teaching is that extra packaging material is wasteful and that large containers should be used less to minimize waste. Although the containers of the present invention use additional packaging material in order to produce both the main compartment and the removable sample compartment, and although the sample compartment is a small compartment with a low product to packaging ratio, the present invention may serve to reduce waste by allowing for resale of the product in the main compartment if the product is returned after the consumer samples the product in the sample compartment.

The sample compartment may contain three or more usages worth of the same product as the main compartment. The manufacturer may produce extra samples at the time of manufacturing of the product so as to allow for later replacement of opened or used sample and allow for retail after return or testing. Alternatively, the sample may simply be used as a stand-alone sample (i.e. travel sample). The container with the attached sample could also be sold in a physical retail space where the consumer may purchase the main compartment with or without the sample compartment attached. In the event that a consumer purchases the main compartment without the sample compartment, the sample compartment may be used as an in-store sample for other consumers to try in-store.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

The following brief and detailed descriptions of the drawings are provided to explain possible embodiments of the present invention but are not provided to limit the scope of the present invention as expressed herein this summary section.

BRIEF DESCRIPTION OF THE DRAWINGS

The features and advantages of the present invention will become apparent from a consideration of the following detailed description presented in connection with the accompanying drawings in which.

DETAILED DESCRIPTION OF THE PREFERRED EMBODIMENT

Figure 1A:
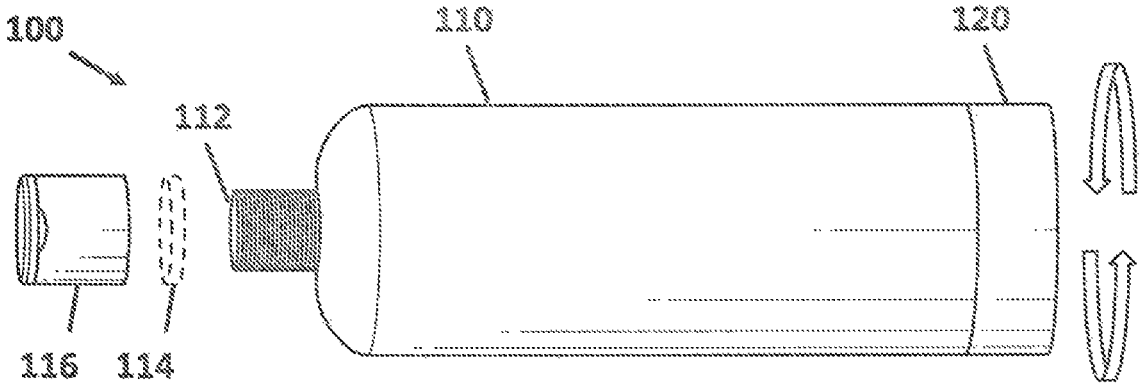
FIG. 1A shows an illustration of a container with a tamper-proof seal and main compartment screw-on, flip-top cap, the container having a removable sample compartment attached to the base of the container.
Figure 1B:
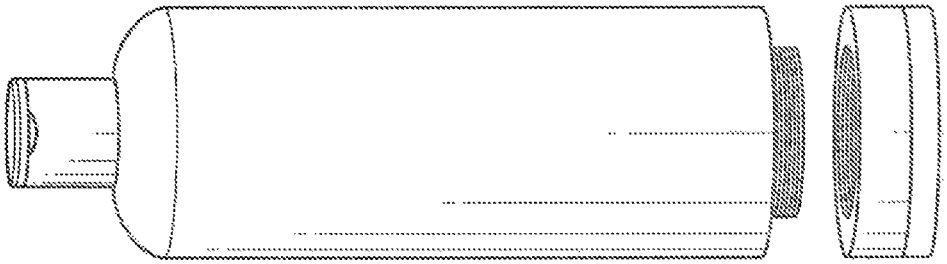
FIG. 1B shows an illustration of the container from FIG. 1A, with the sample compartment unscrewed from the base of the container, where the base of the container is threaded so as to screw into the sample compartment.
Figure 1C:
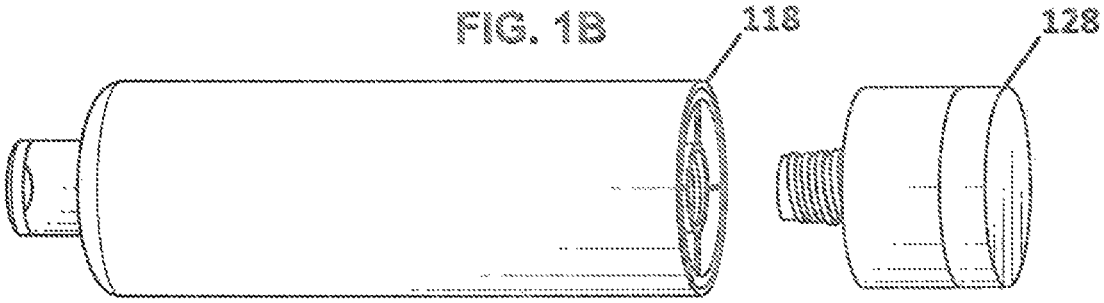
FIG. 1C shows an illustration of an alternative container design where the sample compartment screws into the base of the container.
Figure 1D:
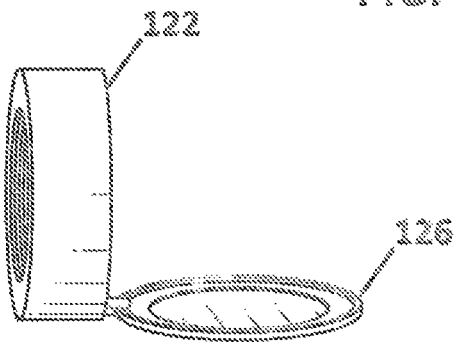
FIG. 1D shows an illustration of a removable sample compartment with a flip-top opening to allow access to the sample.
Figure 1E:
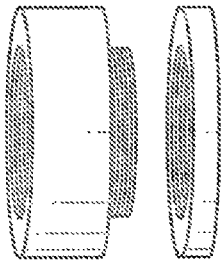
FIG. 1E shows an illustration of a removable sample compartment with a threaded opening to allow access to the sample.
Figure 2A:
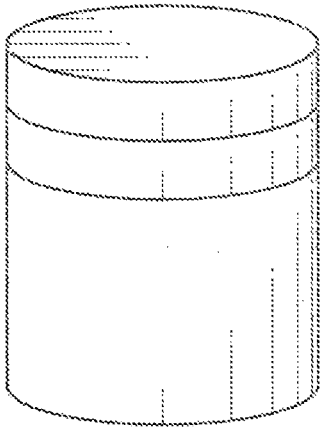
FIG. 2A shows an illustration of a container with a removable sample cap having an integrated sample compartment. The removable cap has a threaded connection is screwed to the top of the main compartment. There may be a tamper-proof seal under the cap to protect the product in the main compartment. The entire cap can be easily removed. It has a solid continuous wall which closes the main compartment and forms the floor of the sample compartment. The sample compartment can be accessed through a flip top, screw top, or other type of closure.
Figure 2B:
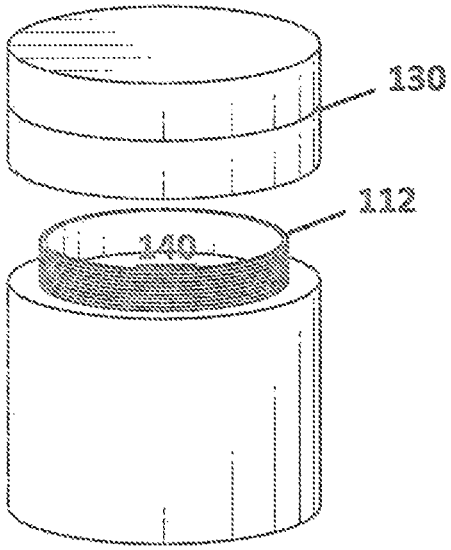
FIG. 2B shows an illustration of the container in FIG. 2A, with the sample cap unscrewed from the container so as to allow access into the main compartment.
Figure 2C:
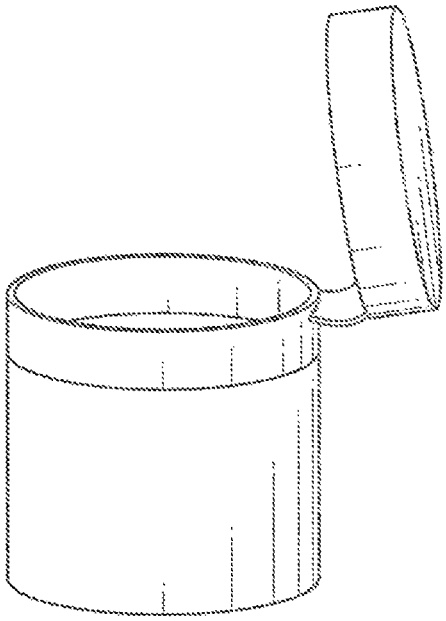
FIG. 2C shows an illustration of the container in FIG. 2A, where the sample compartment is accessed through a flip-top opening of the sample container cap, while leaving the main compartment sealed.
Figure 2D:
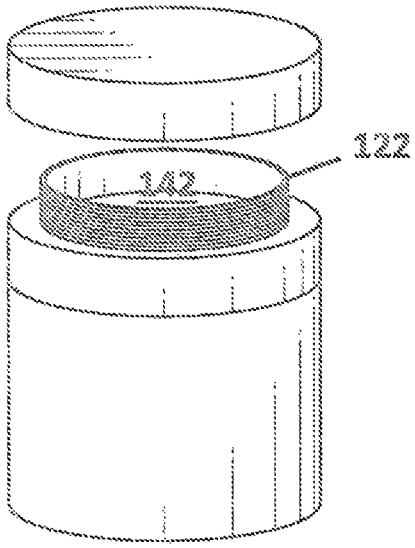
FIG. 2D shows an illustration of the container in FIG. 2A, where the sample compartment is accessed through a threaded opening of the sample compartment cap, while leaving the main compartment sealed. The walls and/or lid of the sample compartment may be transparent so as to allow for the consumer to visualize the actual product before opening the sample compartment and trying the sample product.
Figure 3A:
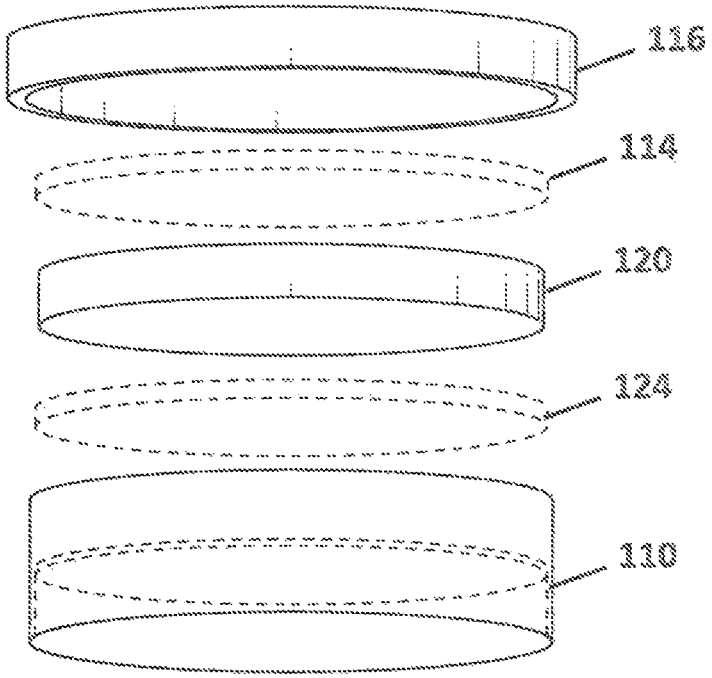
FIG. 3A shows an expanded view illustration of a jar-style container with a bottom main container with an inner lip to support a sample insert, a tamper-proof seal over the main compartment, a removable sample inset, an optional sample compartment tamper-proof seal, and a top lid. The sample insert may be a tray-style compartment.
Figure 3B:
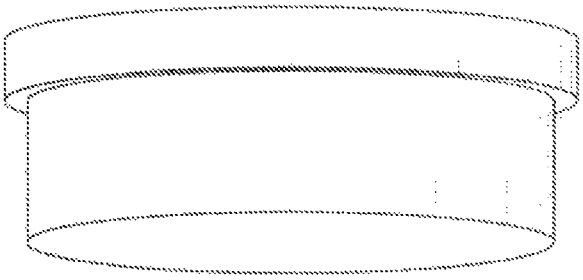
FIG. 3B shows an illustration of the jar-style container of FIG. 3A, with the sample compartment nested within the main compartment and the lid closed overtop.
Figure 4:
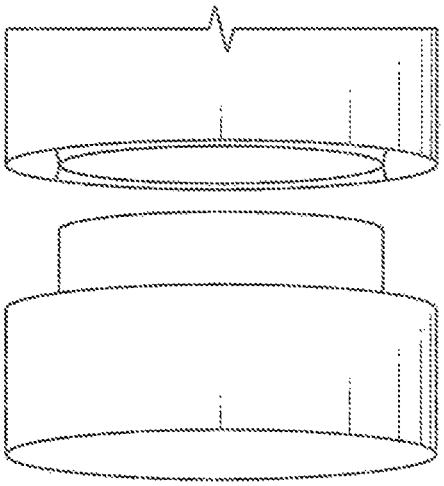
FIG. 4 shows an illustration of a pressure-fit connection between the base of an upper main compartment and a lower removable sample compartment.
Figure 5A:
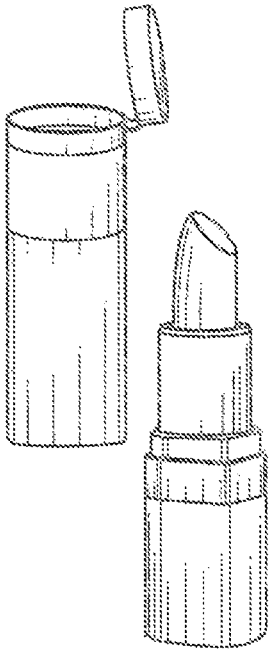
FIG. 5A shows an illustration of a lipstick, lip balm, or crayon container with a sample cap having a removable sample compartment which is accessible through a flip-top.
Figure 5B:
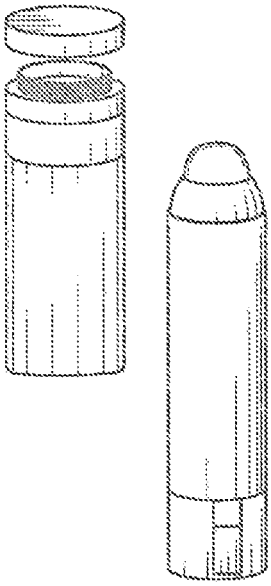
FIG. 5B shows an illustration of a foundation or similar product container with a sample cap having a removable sample compartment which is accessible through a screw-top.
Figure 5C:
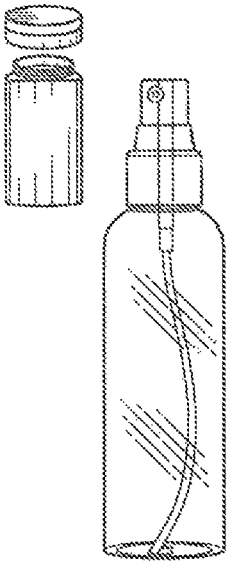
FIG. 5C shows an illustration of a spray-type container with a sample cap having a removable sample compartment unscrewed from the main cap. The spray container may be an airless or non-airless type of container. Airless pump containers are very versatile, provide a better seal, and minimize air interaction with the product, thus increasing product shelf life.
Figure 5D:
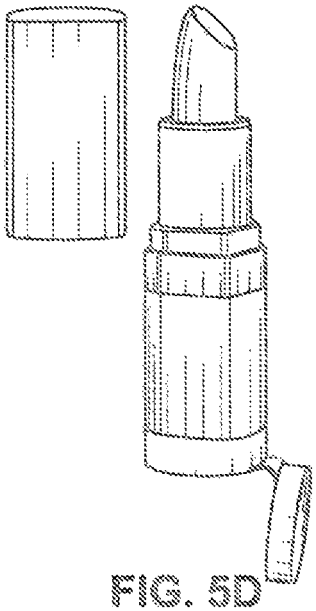
FIG. 5D shows an illustration of a container for products such as lipstick, with a removable sample compartment attached to the base of the container, where the sample compartment is accessible through a flip-top. The main cap and/or sample compartment may be transparent so as to allow for consumer visualization of the actual product. Lipstick is an example product, but other similar products could also be used with this container.
Figure 5E:
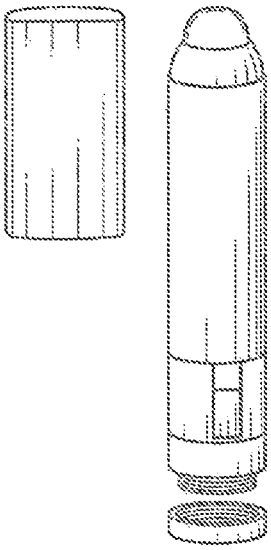
FIG. 5E shows an illustration of a container for products such as makeup, with a removable sample compartment attached to the base of the container, where the sample compartment is accessible by a threaded cap.
Figure 5F:
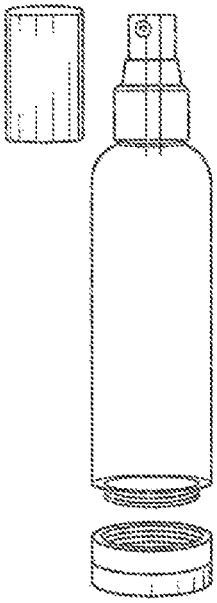
FIG. 5F shows an illustration of a container for products such as perfume, with a removable sample compartment unscrewed from the base of the container. The pump may be an airless or non-airless spray pump. Perfume is an example product, but other similar products could also be used with this container.
Figure 5G:
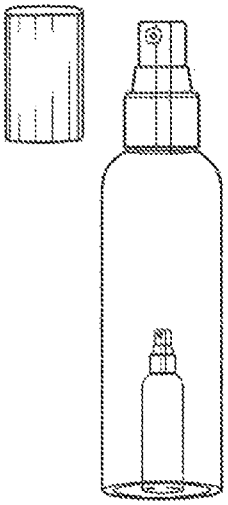
FIG. 5G shows an illustration of a container for products such as perfume, with a removable sample compartment inserted into a cavity in the base of the container. The sample compartment has its own spray pump. Perfume is an example product, but other similar products could also be used with this container.
Figure 6A:
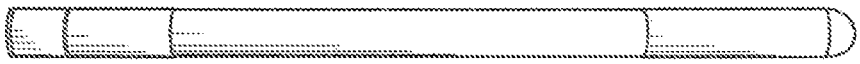
FIG. 6A shows an illustration of a container for products such as makeup pens and pencils, with a cap and a removable sample compartment removably attached to the base of the pen.
Figure 6B:
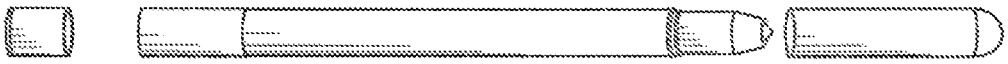
FIG. 6B shows an illustration of the container of FIG. 6A, with both the cap and the removable sample compartment removed.
Figure 6C:
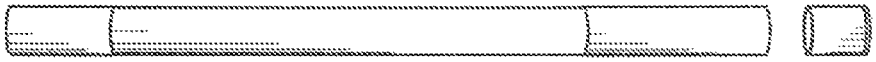
FIG. 6C shows an illustration of a container for products such as makeup pens and pencils, with a sample cap having a sample compartment which has been removed.

The present specification discloses one or more embodiments that incorporate features of the method of the present invention. The disclosed embodiment(s) merely exemplify containers appropriate for implementation of the method of the present invention. The scope of the invention is not limited to the disclosed embodiment(s).

References in the specification to "one embodiment," "an embodiment," "an example embodiment," etc., indicate that the embodiment described may include a particular feature, structure, or characteristic, but every embodiment may not necessarily include the particular feature, structure or characteristic. Moreover, such phrases are not necessarily referring to the same embodiment, Further, when a particular feature, structure, or characteristic is described in connection with an embodiment, it is submitted that it is within the knowledge of one skilled in the art to effect such feature, structure, or characteristic in connection with other embodiments whether or not explicitly described.

Following is a list of elements corresponding to a particular element referred to herein:

100 container
110 main compartment
112 main opening
114 tamper-proof seal
116 main compartment cap
118 main compartment base
120 sample compartment
122 sample opening
124 tamper-proof seal
126 sample compartment cap
128 sample compartment base
130 sample cap
140 product
142 sample In one embodiment, the present invention features a container (100) for a consumable product (140). As a non-limiting example, the container (100) may include a main compartment (110) and a removable sample compartment (120). In some embodiments, the main compartment (110) may have a main opening (112) and be designed to hold the product. In some embodiments, the removable sample compartment (120) may have a sample opening (122) and be designed to hold a sample (142) of the product (140). In some embodiments, the sample compartment (120) may be removably attached to the main compartment (110). In some embodiments, an interior of the sample compartment (120) may be accessed via the sample opening (122) without exposing an interior of the main compartment (110). In this way, the product (140) may be protected from moisture, air, light, tampering, and the environment while the sample (142) is used, tested, or evaluated.

In a preferred embodiment, both the main compartment (110) and the sample compartment (120) may contain the same product (140). In some embodiments, the main compartment (110) and the sample compartment (120) may contain product (140) from the same production batch. In some embodiments, the main compartment (110) may have a main tamper-proof seal (114). As a non-limiting example, the tamper-proof seal may be a plastic film or a different tamper-proof sealing material, either around the exterior of the main compartment cap (116) or affixed underneath the cap over the main compartment opening (112), which must be broken in order to access the interior of the main compartment (110). In preferred embodiments, the sample compartment (120) may be configured to be accessed and replaced without damaging the main tamper-proof seal (114). In a further embodiment, the sample compartment (120) may also comprise a sample tamper-proof seal (124). In some embodiments, the main compartment (110) and the sample compartment (120) may be made from the same material or materials as the sample container or different materials.

In some embodiments, the sample compartment (120) may comprise a sample compartment cap (126) to seal the interior of the sample compartment (120). As a non-limiting example, the sample compartment cap (126) may comprises a flip-top cap or a screw cap. In another embodiment, the sample compartment (120) may be opened by removing the sample compartment (120) from the main compartment (110).

In one embodiment, the product (140) may comprise a food, a cosmetic, a shampoo, a conditioner, a makeup, a lipstick, a skincare product, a foundation, a cream, an ointment, an oil, a spray, a dietary product, a pet product, an herb, a tea, a *cannabis* or hemp related product, a CBD oil, a natural oil, pharmaceutical product, a color cosmetic, a hair product, a food related product, a health and nutrition supplement, a perfume, or any another consumable product as applicable. In some embodiments, the sample compartment (120) may be sized so as to hold about 3 or more uses worth of the product (140). In other embodiments, the sample compartment (120) may be sized so as to hold about 1, 2, 4, 5, 6, 7, 8, 9, 10, 12, 14, 16, 18, 20 or more uses worth of the product (140). In still other embodiments, the sample compartment (120) may have a capacity which is less than about 1, 2, 3, 4, 5, 6, 7, 8, 9, 10, 12, 14, 16, 18, 20, 25, 30, 40, 50, 60, 70, 80, or 90 percent of a capacity of the main compartment (110). In some embodiments, the sample compartment (120) may be reusable. As a non-limiting example, the sample compartment (120) may be cleaned according to regulatory specifications and reused if possible and needed for sampling or travel container. Thus, the sample compartment (120) may comprise a reusable container and may be refilled with the same or a different product (140) after the original product (140) is removed.

In an embodiment, the present invention features a container (100) for a consumable product (140), the container (100) comprising a main compartment (110) and a removable sample cap (130). In some embodiments, the main compartment (110) may have a main opening (112) and be configured to hold the product (140). In some embodiments, the removable sample cap (130) may be configured to seal the main opening (112) and may comprise a main compartment cap (116), and a sample compartment (120). In preferred embodiments, the sample compartment (120) may be integrated within the sample cap (130) and may have a sample opening (122). In some embodiments, the sample compartment (120) may be configured to hold a sample (142) of the product (140). In some embodiments, the sample cap (130) may be removably attached to the main compartment (110), and an interior of the sample compartment (120) may be configured to be accessed without exposing an interior of the main compartment (110).

Figure 7A:
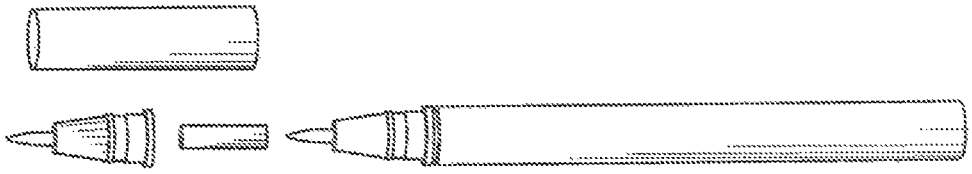
FIG. 7A shows an illustration of a container for products such as makeup pens and pencils, with a seal for the main tip, a removable sample tip which fits over the main tip, and a cap.
Figure 7B:
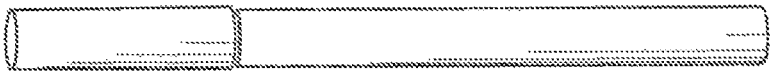
FIG. 7B shows an illustration of the container of FIG. 7A, with the lid, sample tip, and main tip seal nested over the main tip.
Figure 8A:
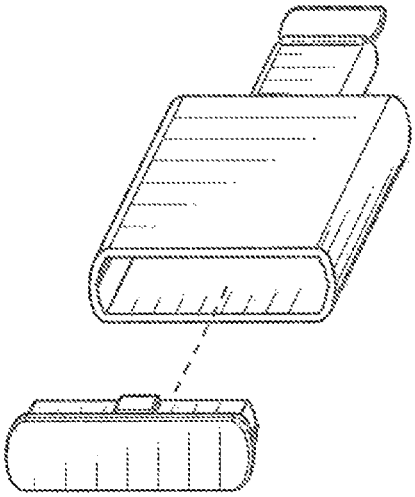
FIG. 8A shows an illustration of a container with a flip-top lid for a main compartment, and a cavity in the base of the container into which a removable sample compartment may be inserted and held into place by a mechanism such as pressure fit tabs.
Figure 8B:
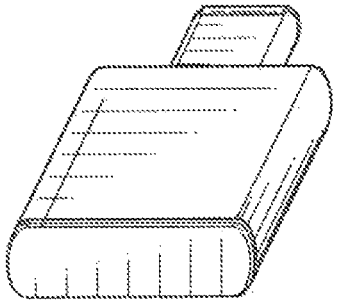
FIG. 8B shows an illustration of the container of FIG. 8A, having the sample compartment inserted into the cavity.
Figure 8C:
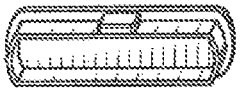
FIG. 8C shows an illustration of the sample compartment of FIG. 8A, and a hollow area within the sample compartment where a sample product may be held.
Figure 9A:
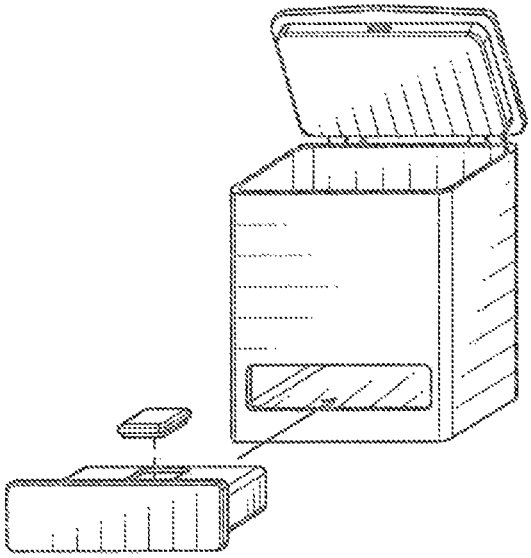
FIG. 9A shows an illustration of a container with a hinged main compartment lid and a cavity in the side of the container into which a removable sample compartment may be inserted and held into place by a mechanism such as pressure fit tabs. One such tab may serve as a removable lid to allow access into the sample compartment, the top of the sample compartment may be open, or the sample compartment may be accessed through another suitable closure mechanism.
Figure 9B:
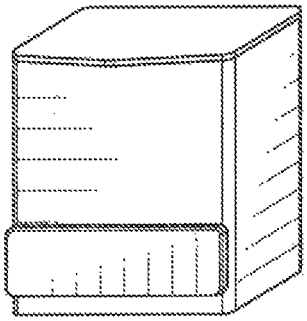
FIG. 9B shows an illustration of the container of FIG. 9A, having the sample compartment inserted into the cavity.
Figure 10A:
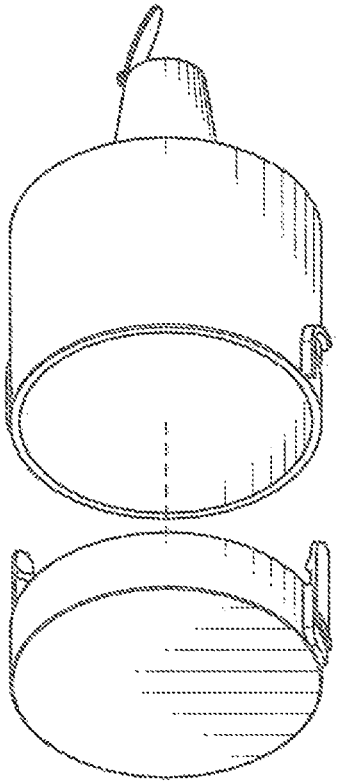
FIG. 10A shows an illustration of a container having a flip-top lid for a main compartment, and a removable sample compartment which may be removably affixed to a base of the container via latches. The latches may be of the sort which release grip when a lower portion of the latch is depressed.
Figure 10B:
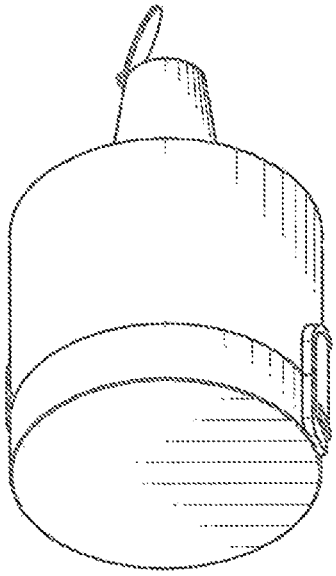
FIG. 10B shows an illustration of the container of FIG. 10A, having the sample compartment affixed to the base of the main compartment via the latches.
Figure 11A:
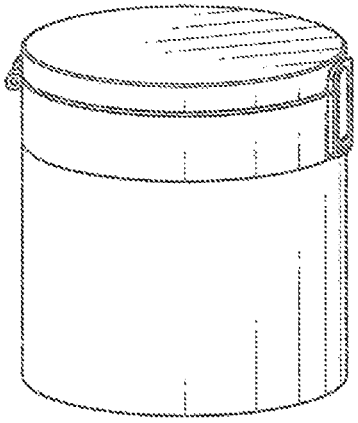
FIG. 11A shows an illustration of a container having a screw-top lid covering a main compartment, said lid having an integrated sample compartment which may be accessed via a hinged lid which has a latch mechanism. The latch mechanism may be released by depressing a lower portion of the mechanism.
Figure 11B:
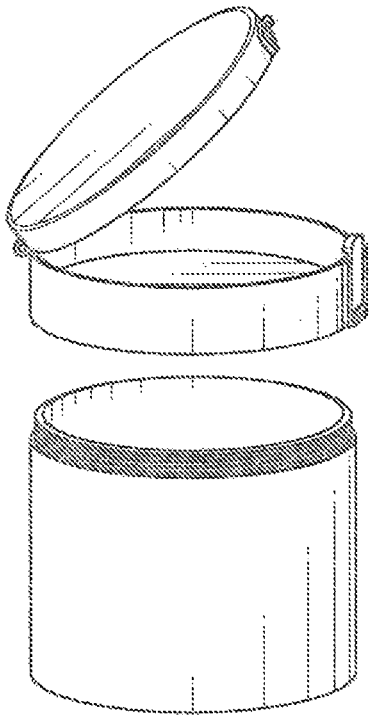
FIG. 11B shows an illustration of the container of FIG. 11A, having the main compartment lid unscrewed and the hinged sample lid unlatched.

According to some embodiments, the main compartment cap (116) may seal the main opening (112). In some embodiments, the sample cap (130) may be a double-cap and comprise a sample compartment cap (126) which seals the sample opening (124). As a non-limiting example, the sample compartment cap (126) may comprise a screw cap or a flip cap. In some embodiments, the main opening (112) may comprise a main pen tip, and the sample cap (130) may comprise a sample pen tip which is configured to fit over the main pen tip, as shown in FIGS. 7A and 7B.

In one embodiment, the present invention features a container (100) for a consumable product (140), the container (100) comprising a main compartment (110) and a removable sample compartment (120). In some embodiments, the main compartment (110) may be configured to hold the product (140) and may comprise a main opening (112) and a base (118). In some embodiments, the removable sample compartment (120) may be configured to hold a sample (142) of the product (140) and may have a sample opening (122). In some embodiments, the sample compartment (120) may be removably attached to the base (118) of the main compartment (110) such that the container (100) is configured to rest on the sample compartment (120). In some embodiments, an interior of the sample compartment (120) may be configured to be accessed without exposing an interior of the main compartment (110).

According to one embodiment, the sample compartment (120) may be attached to the base (118) of the main compartment (110) via a magnet, a screw fitting, a pressure fitting, by latches, by a coupling lip or flange, a hinge, or by any other coupling mechanism. As a non-limiting example, the sample compartment (120) may be attached to the base (118) of the main compartment (110) via a latch which releases the sample compartment (120) when a latch-release is depressed. In some embodiments, the container (100) may be configured to rest upright on the main compartment base (118) when the sample compartment (120) is detached and on a sample compartment base (128) when the sample compartment (120) is attached.

Figure 12:
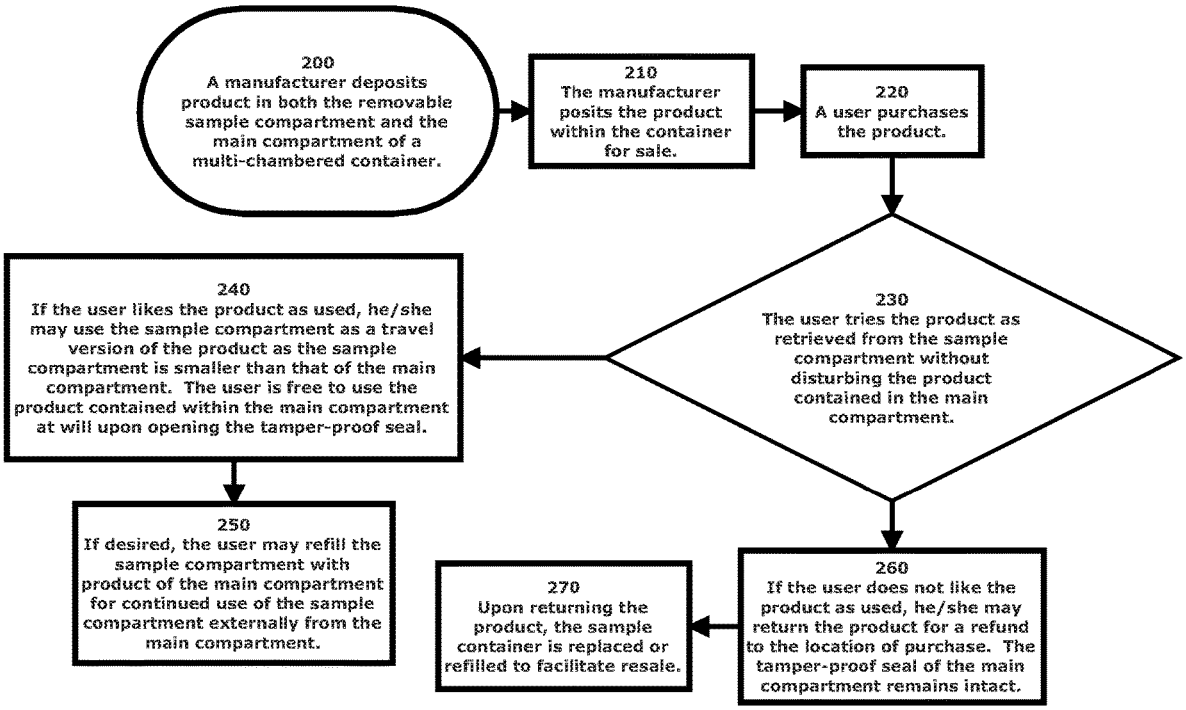
FIG. 12 exhibits a flow chart detailing the method of use of the present invention by a user.

The method of use of the container system of the present invention, as shown in FIG. 12, is preferably as follows:

1. A manufacturer deposits product in both the removable sample compartment and the main compartment of a multi-chambered container. (200) The product of the sample compartment is preferably identical to that of the main compartment; and sample compartment is preferably made of the—similar materials as that of the main compartment. The main compartment is sealed with a main compartment tamper-proof seal. The sample compartment may similarly be equipped with a sample compartment tamper-proof seal. It should be understood that the sample compartment should be clearly marked to be used first, prior to using the main compartment.
2. The manufacturer posits the product within the container for sale. (210)
3. A user (consumer) purchases the product. (220) It should be noted that upon purchase, the user is instructed to only break a seal on the sample compartment and to use the contents of the sample compartment. The user is also instructed that breaking a seal on the main compartment will prevent the product from being returnable.
4. The user tries the product as retrieved from the sample compartment without disturbing the product contained in the main compartment. (230) The tamper-proof seal is left intact. The user may opt to (or be required to) separate the sample compartment from the main compartment to facilitate trial of the product. It should be noted that the user is instructed to try the sample compartment without disturbing the product contained in the main compartment. The user is also instructed that should another sample compartment be desired, to request another sample compartment rather than breaking the seal on the main compartment and using the contents of the main compartment.
5. If the user likes the product as used, he/she may use the sample compartment as a travel version of the product as the sample compartment is smaller than that of the main compartment. The user is free to use the product contained within the main compartment at will upon opening the tamper-proof seal. (240) The user is free to use the entirety of the product housed within the sample compartment and still be eligible for returning the product. Again, it should be noted that the user is instructed to try the sample compartment without disturbing the product contained in the main compartment. It should be understood that the sample compartment can be transparent to determine if the sample was used.

6. If desired, the user may refill the sample compartment with product of the main compartment for continued use of the sample compartment externally from the main compartment. (250) As such, the sample compartment may be used as a travel container.
7. If the user does not like the product as used, he/she may return the product for a refund to the location of purchase. The tamper-proof seal of the main compartment remains intact. (260) The refund can be full or partial (the consumer may be charged for the sample as applicable).
8. Upon returning the product, the sample container is replaced or refilled to facilitate resale. (270) It should be noted that the main compartment still has a seal that is unbroken for resale, and the user has been instructed to only break a seal on the sample compartment but not a seal on the main compartment to ensure the main compartment can be returned. This ensures that the sample compartment use in no way compromises the seal and product of the main compartment. The method of the present invention can be repeated over and over again until the seal on the main compartment has been broken by the user. When the sample container is replaced or refilled, the manufacturer or retailer ensures that a tamper-proof seal is secured atop the newly provided sample when attached to the main compartment.

EXAMPLES

The following is a non-limiting example of the present invention. It is to be understood that said example is not intended to limit the present invention in any way. Equivalents or substitutes are within the scope of the present invention.

Example 1

A shampoo manufacturer produces shampoo bottles with double caps which contain a sample compartment filled with enough shampoo for about 3-5 uses. The manufacturer provides a distributer with 100 capped shampoo bottles and 15 extra caps. A consumer purchases a bottle, and tries the shampoo from the sample compartment, but does not damage the main compartment tamper-proof seal. The consumer returns the shampoo bottle to the distributer for a refund. The distributer replaces the used sample cap with a new sample cap and sells the unused bottle to a new consumer.

Example 2

A perfume company produces spray perfume vials with removable sample compartments screwed to the bottom, and a tamper-proof seal over the main cap. A consumer purchases one of the vials from the internet and receives it in the mail, having never smelled the fragrance of the perfume. The consumer opens the sample compartment, smells and applies the perfume, but does not damage the tamper-proof seal. The consumer mails the vial back to the company and receives a refund. The company cleans and refills the sample compartment, before shipping the same vial, or a different sample vial to a new consumer.

Example 3

A manufacturer produces 10,000 units of lipstick with a transparent cap filled with a sample of the same lipstick product as is in a main compartment. Each sample contains enough product for 3 to 5 uses. The manufacturer produces an additional 150 sample caps which may be used to replace used sample caps on returned products. The main compartment is protected by a tamper-proof seal. Because the cap is transparent, consumers may visualize the product even before opening the sample compartment or open the transparent cap and try the product. Additionally, the extra caps may be used as stand-alone samples in a retail store setting to allow consumers to try the product without opening the main compartment.

Example 4

A customer is known to use shampoo (or similar personal product) when away on vacation during travel. Shampoo is sold in travel containers for this reason, but they are limited in their brand variety and scope. If the user is allergic to the prominent brands which are sold in travel containers, the customer may be encouraged to purchase a refillable travel-sized bottle to fill his/her own allergy-free shampoo into the bottle. However, most refillable travel-sized bottles available for purchase are made of silicone. Many customers are also allergic to silicone, and silicone reacts poorly with many products such as sulfur emulsifier. Instead of this lengthy process, the customer can simply use the removable sample compartment of the product, refilled if necessary, during travel as the removable sample compartment is small enough for legal travel and is easily separated from the main compartment.

As used herein, the term "about" refers to plus or minus 10% of the referenced number.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting essentially of" or "consisting of", and as such the written description requirement for claiming one or more embodiments of the present invention using the phrase "consisting essentially of" or "consisting of" is met.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A method for sampling a product via a multi-chambered container comprising:

depositing a sample portion of a product in a removable first sample compartment of the container;

depositing a main portion of the product in a main compartment of the container;

wherein the sample portion of the product housed within the removable first sample compartment and the main compartment is identical in composition;

wherein the removable first sample compartment and the main compartment are made of a same material;

wherein the main compartment is equipped with an opening covered by a tamper-proof seal;

selling the product as housed within the main compartment and the first sample compartment to a user at a retailer;

removing the first sample compartment from the main compartment;

dispensing the sample portion of the product from the first sample compartment via a sample compartment opening;

trying the sample portion of the product on a trial basis from the first sample compartment, leaving the main portion of the product of the main compartment undisturbed;

wherein the first sample compartment is closed on one end via a sample compartment cap, and comprises a threaded connection on the other end configured to be attached to a bottom of the main compartment; and repeated attachment of further sample compartments to the main compartment, wherein an attachment of the repeated attachments occurs upon each instance of a return to the retailer of the main compartment in a sealed state, such that the main compartment is repeatedly sold by the retailer until the seal on the main compartment has been disturbed.

2. The method of claim 1, further comprising:

returning the multi-chambered container to the retailer with the tamper-proof seal of the main compartment intact; and the retailer issuing a refund to the user.

3. The method of claim 1, wherein the first sample compartment is protected by a sample compartment tamper-proof seal.

4. The method of claim 3, further comprising: the retailer refusing to accept a return of the main compartment if the tamper-proof seal of the main compartment has been tampered with.

5. The method of claim 3, wherein the user is instructed that return of the main compartment is permitted even though the sample compartment tamper-proof seal of the first sample compartment have been disturbed.

6. The method of claim 5, wherein the product comprises a product selected from the following group: a food, a dietary product, a nutrition product, a natural oil, an herb, a tea, a skincare product, a cosmetic, a color cosmetic, a shampoo, a conditioner, a makeup, a lipstick, a foundation, a cream, pharmaceutical product, pet industry product, an ointment, an oil, a spray, a pet product, a hair product, a fragrance, or a perfume.

7. The method of claim 1, further comprising: an exterior of the multi-chambered container providing text-based instructions for use of the first sample compartment prior to use of the main compartment; and the exterior of the multi-chambered container providing instructions for use of the first sample compartment as a refillable miniature container, isolated from the main compartment, for use during travel.

8. The method of claim 1, further comprising: replacing the first sample compartment of the multi-chambered container with a second sample compartment upon return of the container to the retailer.

9. A method for containing, distributing, and using a consumable product via a container comprising:

disposing a main portion of the consumable product in a main compartment of the container via a main opening, wherein the main opening is covered by a tamper-proof seal;

disposing a sample portion of the consumable product within a first sample compartment of the container via a sample opening;

wherein the first sample compartment is removable from the main compartment;

the first sample compartment adhering to the main compartment of the container;

instructing a user to not disturb the main compartment of the container unless purchase of the main compartment is desired by the user;

wherein the first sample compartment is removably attached to the main compartment;

wherein an interior of the first sample compartment is configured to be accessed without exposing an interior of the main compartment;

wherein the first sample compartment is closed on one end via a sample compartment cap, and comprises a threaded connection on the other end configured to be attached to a bottom of the main compartment; and repeated attachment of new sample compartments to the main compartment, wherein an attachment of the repeated attachments occurs upon each instance of a return of the main compartment in a sealed state to the retailer, such that the main compartment is repeatedly sold by the retailer until the tamper-proof seal on the main compartment has been disturbed.

10. The method of claim 9, further comprising: returning the main compartment of the container to a retailer and receiving a refund if the main compartment has not been disturbed, the main compartment remaining protected by the tamper-proof seal.

11. The method of claim 9, wherein a sample cap is a double-cap and comprises a sample compartment cap which seals the sample opening; and further comprising the user using the sample portion of the consumable product with the first sample compartment and receiving a refund if the main compartment has not been exposed.

12. The method of claim 11, wherein the sample compartment cap opens via a screw cap.

13. The method of claim 9, wherein both the main compartment and the first sample compartment contain a product that is identical in composition.

14. The method of claim 13, wherein the first sample compartment is equipped with a sample tamper-proof seal.

15. The method of claim 9, wherein the product comprises a product selected from the following group: a food, a dietary product, a nutrition product, a natural oil, an herb, a tea, a skincare product, a cosmetic, a color cosmetic, a shampoo, a conditioner, a makeup, a lipstick, a foundation, a cream, pharmaceutical product, pet industry product, an ointment, an oil, a spray, a pet product, a hair product, a fragrance, or a perfume.

16. The method of claim 9, wherein the first sample compartment is transparent for product visualization.

* * * * *